US008522571B2

(12) United States Patent
Smith

(10) Patent No.: US 8,522,571 B2
(45) Date of Patent: Sep. 3, 2013

(54) VARIABLE CAPACITY ICE STORAGE ASSEMBLY

(75) Inventor: Lindsey A. Smith, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1186 days.

(21) Appl. No.: 12/033,333

(22) Filed: Feb. 19, 2008

(65) Prior Publication Data

US 2009/0205358 A1 Aug. 20, 2009

(51) Int. Cl.
*F25C 5/18* (2006.01)
*F25D 3/02* (2006.01)

(52) U.S. Cl.
USPC ..... 62/344; 62/459; 221/64; 221/65; 220/495.01; 220/530; 220/532; 220/551

(58) Field of Classification Search
USPC ..... 62/344, 459, 237–239; 221/64–65, 221/197, 287; 220/495.01, 530–533, 544, 220/545, 550, 551, 557
See application file for complete search history.

(56) References Cited

U.S. PATENT DOCUMENTS

| | | | | |
|---|---|---|---|---|
| 2,717,505 | A | | 9/1955 | Anderson |
| 3,230,591 | A | * | 1/1966 | Holton ..... 24/163 R |
| 3,436,928 | A | | 4/1969 | Swerbinsky |
| 3,892,105 | A | | 7/1975 | Bernard |
| 4,649,717 | A | | 3/1987 | Tate, Jr. et al. |
| 4,835,978 | A | | 6/1989 | Cole |
| 4,942,979 | A | | 7/1990 | Linstromberg et al. |
| 5,082,139 | A | * | 1/1992 | Quam ..... 220/530 |
| 5,160,094 | A | | 11/1992 | Willis et al. |
| 5,350,085 | A | * | 9/1994 | Kidd et al. ..... 222/146.6 |
| 5,615,797 | A | * | 4/1997 | Ripamonti ..... 220/529 |
| 6,082,130 | A | * | 7/2000 | Pastryk et al. ..... 62/344 |
| 6,148,624 | A | | 11/2000 | Bishop et al. |
| 6,314,745 | B1 | | 11/2001 | Janke et al. |
| 6,324,855 | B1 | | 12/2001 | Mullis |
| 6,405,553 | B1 | | 6/2002 | Willett |
| 6,425,259 | B2 | | 7/2002 | Nelson et al. |

(Continued)

FOREIGN PATENT DOCUMENTS

| | | |
|---|---|---|
| JP | 2000180005 | 6/2000 |
| JP | 2001153515 | 6/2001 |

OTHER PUBLICATIONS

Search FAQ's; http://whirlpool.custhelp.com; 2007.*

*Primary Examiner* — Frantz Jules
*Assistant Examiner* — Cassey D Bauer
(74) *Attorney, Agent, or Firm* — Kirk W. Goodwin; Diederiks & Whitelaw PLC

(57) ABSTRACT

A variable capacity ice storage assembly for a refrigerator freezer compartment includes a removable insert adapted to be positioned within an ice storage bucket to alter the storage capacity of the ice bucket. The insert includes one or more tabs having clips thereon for attaching the insert to one or more side walls of the ice bucket. The tabs are fixed to a main body portion having a first solid deflector extending at a first angle there from and a second solid deflector extending at a second angle. One or more hinges may be utilized to connect parts of the insert, resulting in a reconfigurable insert that can be utilized in multiple positions. When utilized in an auger-type ice dispensing system, the insert is sized such that the main body portion of the insert does not interfere with the function of the auger.

18 Claims, 7 Drawing Sheets

(56) References Cited

U.S. PATENT DOCUMENTS 6,438,976 B2 8/2002 Shapiro et al.
6,763,674 B2 7/2004 Siefker
7,062,935 B2 6/2006 Siefker
7,083,064 B2 * 8/2006 Zorzo ..... 220/529

* cited by examiner

VARIABLE CAPACITY ICE STORAGE ASSEMBLY

BACKGROUND OF THE INVENTION

1. Field of the Invention

The present invention pertains to the art of refrigerators and, more particularly, to a variable capacity ice storage assembly for a refrigerator.

2. Description of the Related Art

Automatic ice making systems for use in domestic refrigerators are well known. A typical ice making system includes an ice maker mounted within the freezer compartment of the refrigerator and an ice storage receptacle or bin supported beneath the ice maker for receiving the formed ice from the ice maker. The ice maker is commonly mounted within the freezer compartment adjacent the side or rear wall of the freezer compartment such that water and power can be readily supplied to the ice maker. The ice storage receptacle is supported by a shelf or other structure arranged beneath the ice maker within the freezer compartment. The ice storage receptacle generally extends across a significant portion of the freezer compartment and has a front end adjacent the freezer door. U.S. Pat. No. 4,942,979 to Linstromberg et al. is an example of such a prior art ice making system. Alternatively, it is also known to provide a removable ice storage bucket on the door of a freezer compartment, as illustrated in U.S. Pat. No. 6,425,259 to Nelson et al.

Conventional ice making systems are designed to produce and maintain a relatively fixed quantity of ice pieces. This leads to the potential problem of ice staleness for consumers who have relatively low ice consumption needs. U.S. Pat. No. 4,835,978 to Cole discloses a common means used to limit the quantity of ice formed by the ice maker. In Cole, an ice quantity sensor, comprising a sensing arm, is periodically lowered into the ice storage receptacle for sensing the amount of ice supplied into the storage receptacle.

To avoid the problem of ice staleness, it is desirable to limit the amount of ice available based on individual consumers ice consumption. U.S. Pat. Nos. 3,436,928 and 6,148,624 illustrate past efforts to provide flexibility in the amount of ice stored in an ice bin. More specifically, the '928 patent discloses a vertically telescoping ice receptacle, while the '624 patent discloses a system wherein an ice bucket can be vertically adjusted relative to an ice maker. In addition to other problems, these systems require specialize structure and cannot be utilized with standard pre-existing ice dispensing systems.

The present invention addresses the need for a variable capacity storage assembly that can be readily employed without necessitating alterations to pre-existing ice making systems.

SUMMARY OF THE INVENTION

The present invention is directed to a variable capacity ice storage assembly for a refrigerator freezer compartment including an ice sensing system and a removable ice storage bucket positioned below an ice maker. A removable insert is provided that can be placed into the ice bucket by a consumer to alter the ice storage capacity of the ice bucket. More specifically, the insert includes one or more tabs having clips thereon for attaching the insert to one or more side walls of the ice bucket. The tabs are fixed to a main body portion having a first solid deflector extending at a first angle therefrom and a second solid deflector extending at a second angle therefrom.

One or more hinges may be utilized to connect various parts of the insert, resulting in a reconfigurable insert that can be utilized in multiple positions. Such a reconfigurable insert may including "locking" hinges, or may be utilized with an ice bucket having multiple slotted retainers for holding the insert in a desired position.

In use, the main body portion extends into the storage cavity of the ice bucket, effectively reducing the storage volume of the ice bucket. When utilized in an automatic ice dispensing system employing an ice delivery auger, the insert is configured such that the main body portion of the insert does not interfere with the function of the auger. Thus, the ice storage volume can be adapted to a particular user's needs, preventing prolonged ice-storage and the development of stale ice.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
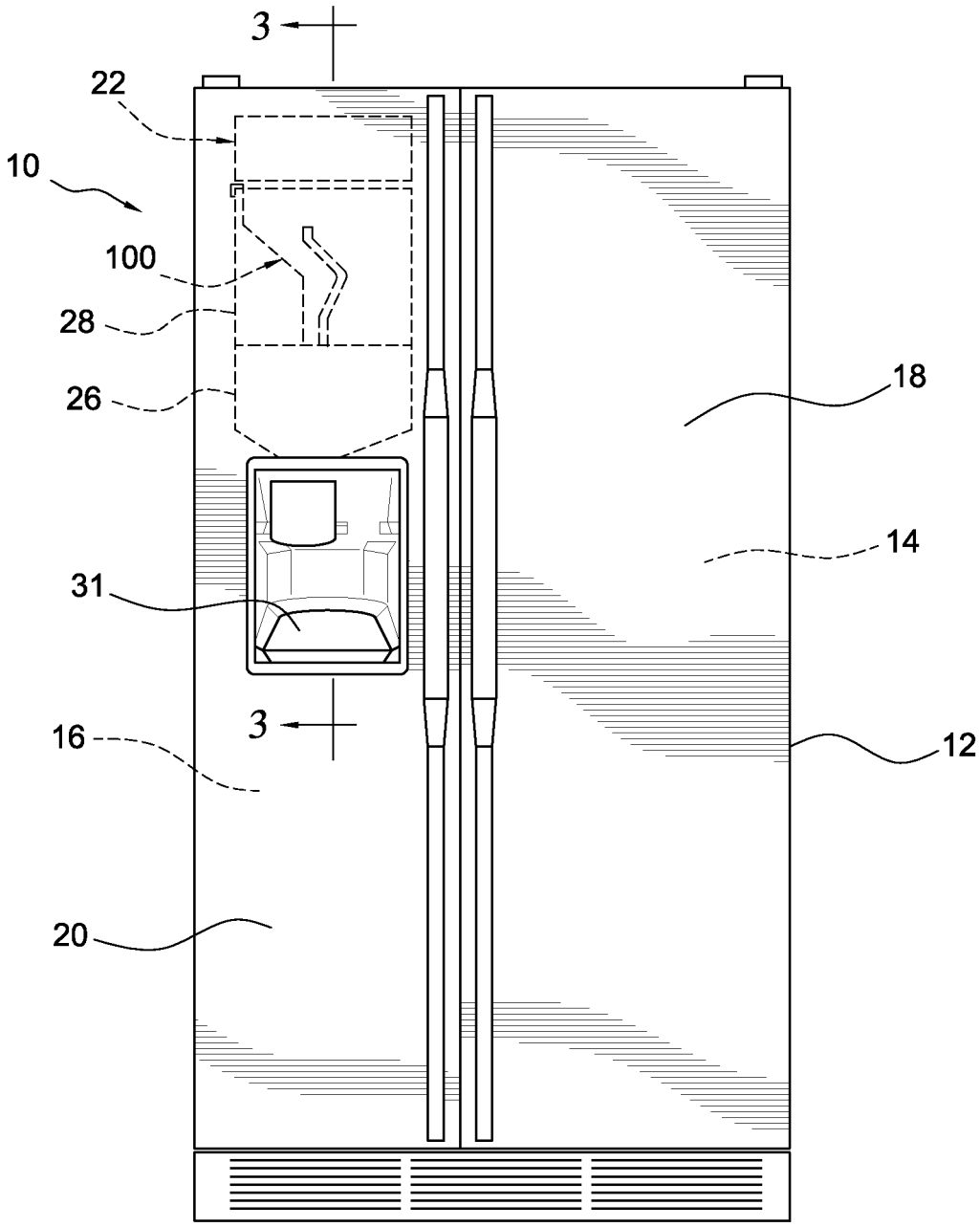
FIG. 1 is a front elevational view of a refrigerator incorporating an ice storing and dispensing assembly with a door-mounted ice bucket and an insert constructed in accordance with a first embodiment of the present invention.
Figure 2:
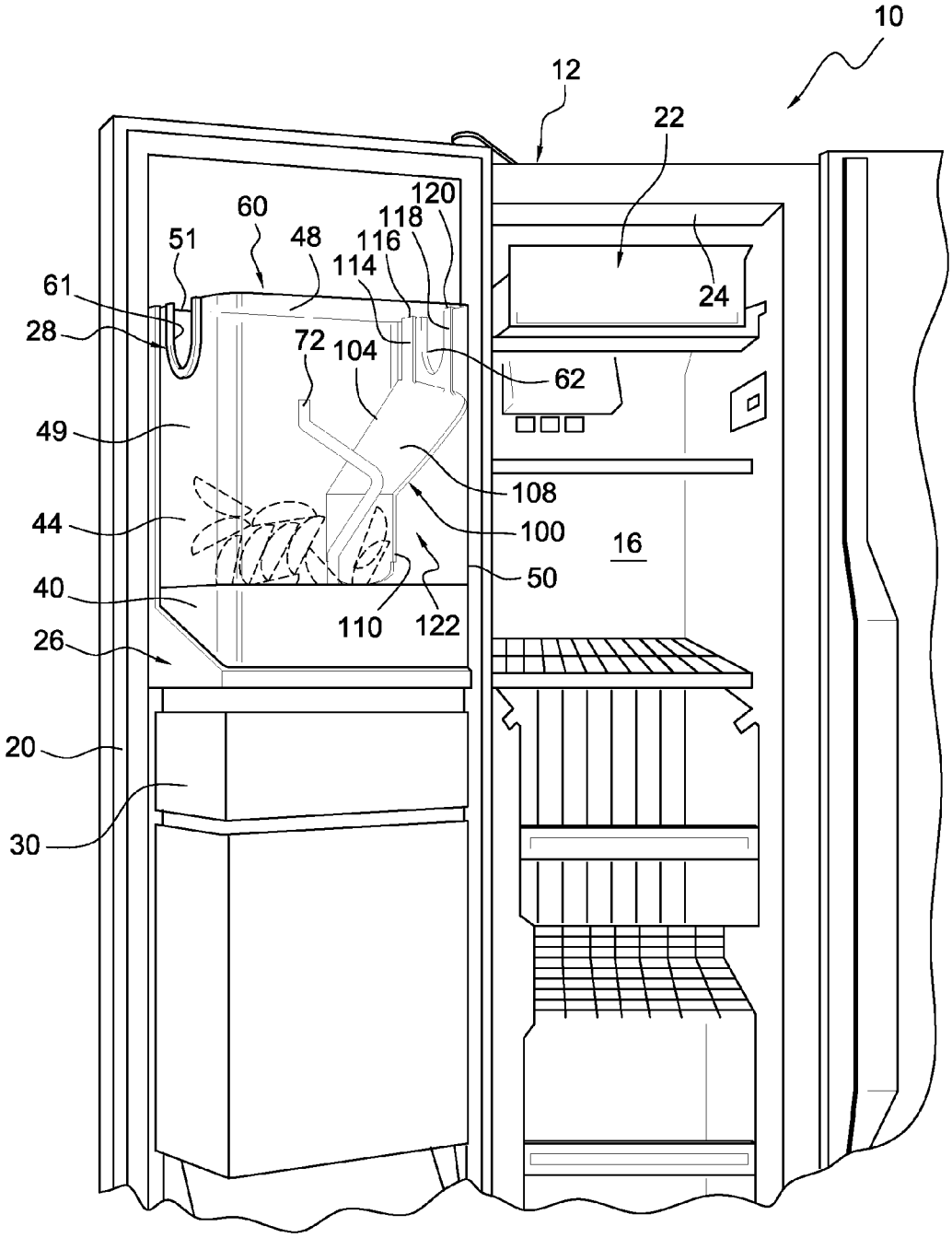
FIG. 2 is a partial perspective view of the ice storing and dispensing assembly of FIG. 1.

With initial reference to FIGS. 1 and 2, a refrigerator 10, defining a side-by-side fresh food/freezer configuration, is provided having a cabinet 12 forming a fresh food compartment 14 and a freezer compartment 16. Both the fresh food compartment 14 and the freezer compartment 16 are provided with access openings. A fresh food door 18 and a freezer door 20 are hingedly mounted to the cabinet 12 for closing the access openings in a manner well known in the art.

Figure 3:
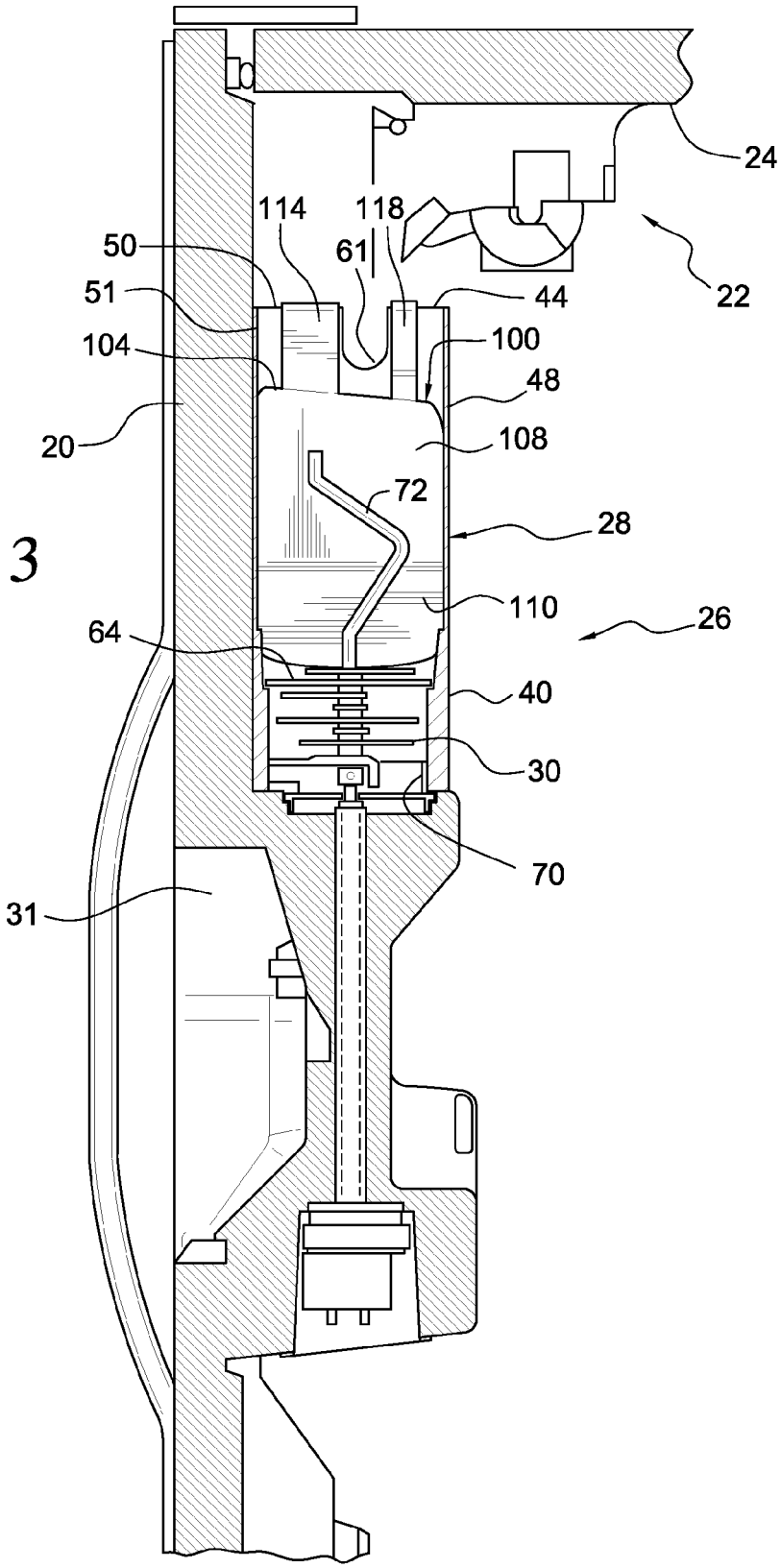
FIG. 3 is a cross-sectional side view of the ice storage and dispensing assembly of FIG. 1.

An ice making assembly 22 is disposed within the freezer compartment 16 and may be mounted to top wall 24 of the freezer compartment 16 as shown, to a side wall, or on freezer door 20, with each of these mounting arrangements also being known in the art. Preferably, ice maker assembly 22 takes the form of a conventional ice piece making apparatus and produces generally crescent shaped ice pieces as depicted in FIG. 3. The ice makers disclosed in U.S. Pat. Nos. 4,649,717 and 5,160,094, herein incorporated by reference, are illustrative of the type of ice makers which may be used in accordance with the present invention.

An ice dispensing system 26, mounted to the freezer door 20, is provided below the ice making assembly 22 for receiving ice pieces. The ice dispensing system 26 includes an ice bucket or bin 28, as well as a lower ice crushing system 30. When operated, the ice dispensing system 26 transfers ice pieces from the bin 28 through the freezer door 20 whereby ice pieces may be dispensed through a forwardly exposed, external ice dispenser station or area 31. One of the benefits of such a system is that ice bin 28 is removable from the freezer door. This allows a user to readily dispense a large quantity of ice from the ice bucket 28 into a receptacle, such as an insulated cooler.

The ice maker assembly 22 is designed to prevent ice harvesting when the ice storage bin 28 is full of ice pieces, when the door 20 is open, or when the ice bucket is removed from the door. The need for this function is well recognized in the ice maker art and a means for providing this function is described in detail in U.S. Pat. Nos. 4,649,717 and 5,160,094, which are incorporated herein by reference.

Any type of conventional ice bucket may be utilized in accordance with the present invention, including auger-type ice bucket 28 illustrated in FIGS. 2 and 3. Ice bucket 28 includes a base 40 and an upper body 44. The upper body 44 has a plurality of vertical walls extending upwardly from the base member 40 including a front wall 48, side walls 49 and 50, and a back wall 51. Together with the base member 40, the walls 49-51 define a storage cavity 60 for collecting ice pieces produced by ice maker assembly 22. The upper body 44 is preferably formed from a clear plastic material such that the quantity of ice pieces stored within the ice bin 28 can be easily, visually determined, while the base 40 is preferably opaque to hide the dispensing mechanisms contained therein.

In one preferred embodiment, ice bucket 28 is utilized with an auger-type ice dispensing system, such as the one described in U.S. Pat. No. 6,425,259, incorporated herein by reference. Additionally, ice bucket 28 may be utilized in conjunction with different ice-sensing systems, including the infrared sensing system described in U.S. Pat. No. 6,314,745, also incorporated herein by reference. In the preferred embodiment shown, ice bucket 28 includes apertures or slots 61 and 62, which provide a clear path through which an infrared ice-sensing beam can be directed. Turning to FIG. 3, storage cavity 60 of ice bucket 28 includes a bottom wall portion 64 having an ice outlet opening 70 through which the ice pieces must pass to be dispensed. Rotatably supported within the ice bucket 28 is an auger 72. As is known in the art, rotation of auger 72 ensures that ice pieces are free to move downwardly, under the urgings of gravity, towards the ice crushing system 30 such that ice pieces may be dispensed.

In general, the above-described structure is known in the art and does not form part of the present invention. Instead, this description is provided for the sake of completeness. The present invention is particularly directed to providing a removable insert to be selectively positioned in ice bucket 28, thereby allowing a user to selectively alter the capacity of ice bucket 28. In a first embodiment depicted in FIGS. 2 and 3, a removable insert 100 comprises a main body portion 104 including a solid first deflector 108 and a solid second deflector 110 extending there from. Additionally, a first tab portion 114 extends from first deflector 108 in a direction opposite of second deflector 110. First tab portion 114 includes a first clip 116 adapted to selectively connect insert 100 to one of opposing side walls 49 or 50 of ice bucket 28. In a preferred embodiment, insert 100 additionally includes a second tab portion 118 incorporating a second clip 120 adapted to selectively connect insert 100 to ice bucket 28. First and second tab portions 114 and 118 are spaced apart, allowing insert 100 to be attached to side walls 49 or 50 without extending across or otherwise interfering with respective apertures 61 and 62. Thus, insert 100 may be utilized with an infrared ice-sensing system such as the one described in U.S. Pat. No. 6,314,745. In the first embodiment, clips 116 and 120 are depicted as being snapped over the rim of side wall 50, thus secure insert 100 to ice bucket 28. However, clips 116 and 120 may be any known type of clip, such as spring-type clips or clips adapted to frictionally engage a wall of ice bucket 28, for example.

Preferably insert 100 is a one-piece molded plastic insert. However, other suitable materials and constructions may be used without departing from the nature of the invention. Insert 100 may be dimensioned as desired to fit into various sizes of open ice buckets. More specifically, the entire length of insert 100 is preferably sized to extend from the top of a respective wall 48-51 of ice bucket 28 to at or near bottom wall portion 64 of storage cavity 60. The width of insert 100 is preferably sized to extend substantially the entire width between front wall 48 and back wall 51. When utilized with an auger-type dispensing system as shown in FIGS. 2 and 3, insert 100 is shaped such that main body portion 104 does not interfere with the function of auger 72 within ice bucket 28.

As best seen in FIG. 2, first deflector 108 projects at a first angle from first and second tabs 114 and 118, and second deflector 110 projects from first deflector 108 at a second angle, substantially parallel to first and second tabs 114 and 118. The slope of first deflector 110 deflects or funnels ice dropped from ice making assembly 22 to the bottom of ice bucket 28 and to outlet opening 70. Thus, when tab portions 114 and 118 are engaged with one of the walls of ice bucket 28, main body portion 104 extends away from side wall 50, creating a secondary cavity 122 and effectively reducing the usable volume of storage cavity 60. When a user wishes to reduce the storage volume of storage cavity 60, he or she simply places insert 100 within storage cavity 60 and connects first and second tabs 114 and 118 to a select one of side walls 49 or 50. In this way, an ice bucket 28 having a normal capacity of 10 lbs. of ice will have a reduced capacity of, for example, 7 lbs. of ice. The smaller amount of ice storage will allow for a quicker turn-around of old ice with new ice, and will reduce the instances of stale ice within ice bucket 28.

Figure 4:
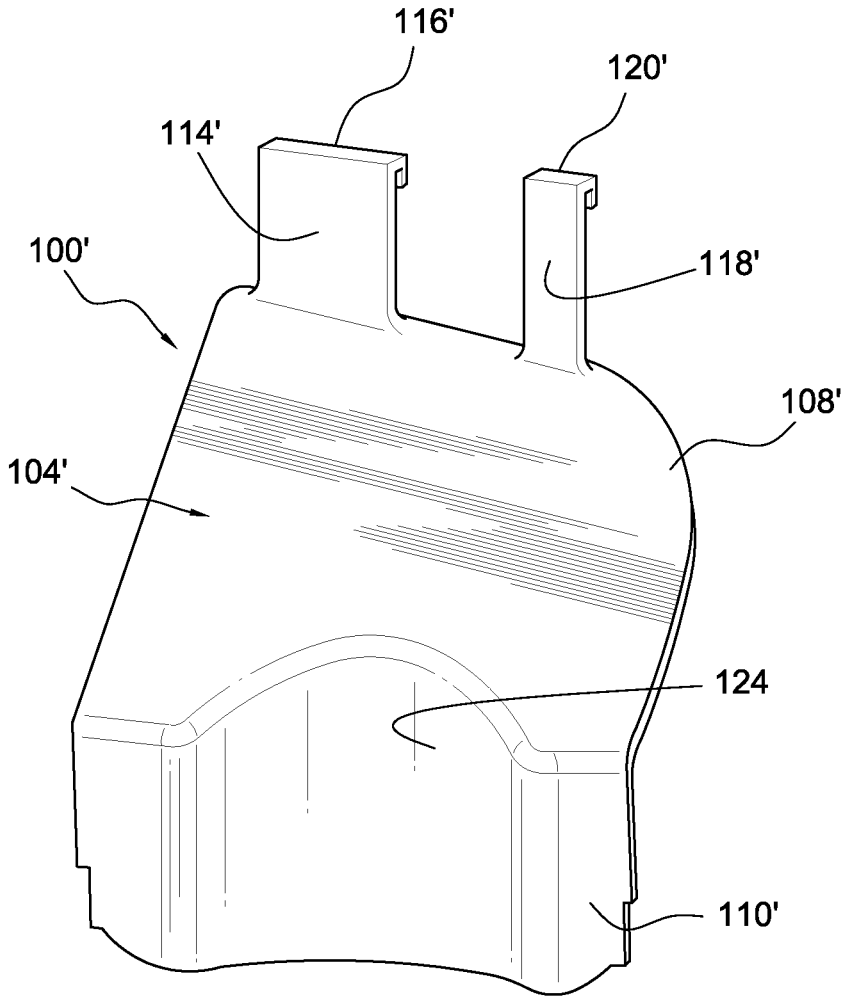
FIG. 4 is a perspective view of a second insert embodiment of the present invention.

A second embodiment including an insert 100', as shown in FIG. 4, is a slight variation of the first embodiment and includes a main body portion 104' including first and second deflectors 108' and 110', and first and second tab portions 114' and 118' including respective clips 116' and 120'. In addition, a curved portion 124 extends from a first deflector 108' to second deflector 110'. This configuration allows the size of insert 100' to be increased while maintaining a sufficient distance between the auger 72 and main body portion 104'. Furthermore, curved portion 124 provides clearance for ice cubes being moved by the auger 72 and prevents ice cubes from jamming up against insert 100' during movement of the auger 72.

Figure 5A:
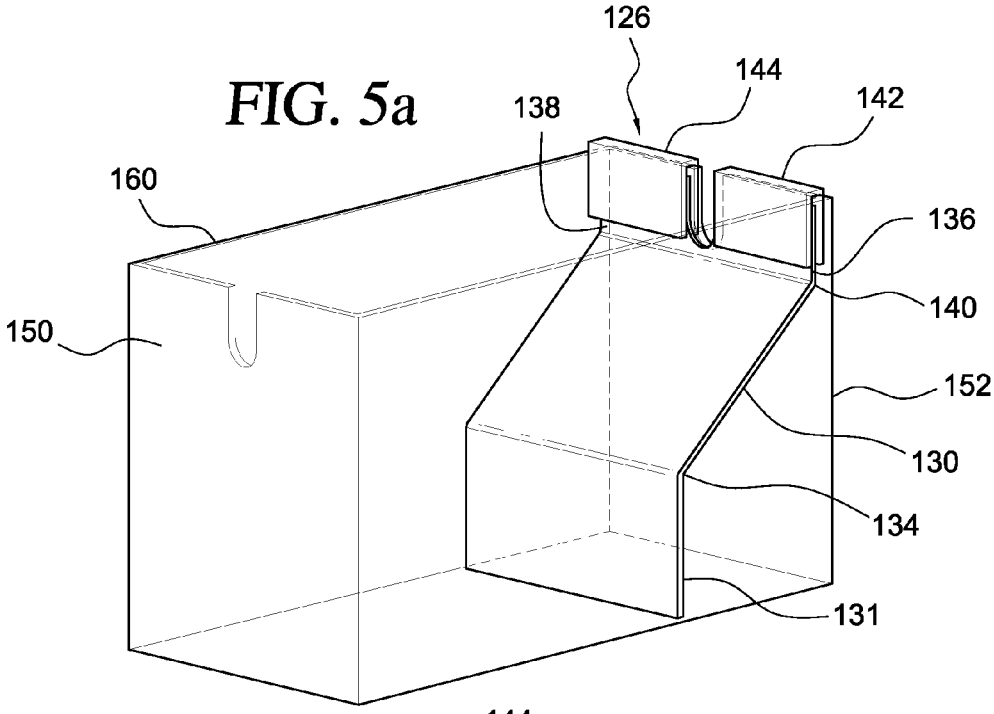
FIGS. 5*a* and 5*b* show a third insert embodiment of the present invention in two different configurations within a shelf-mounted ice bucket.
Figure 5B:
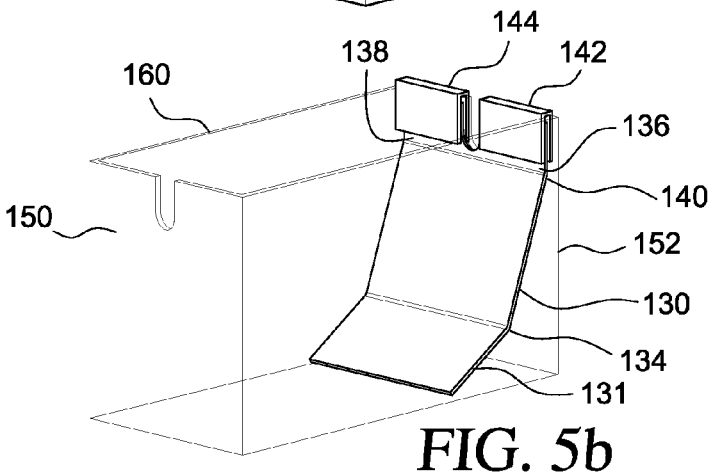
Figure 5C:
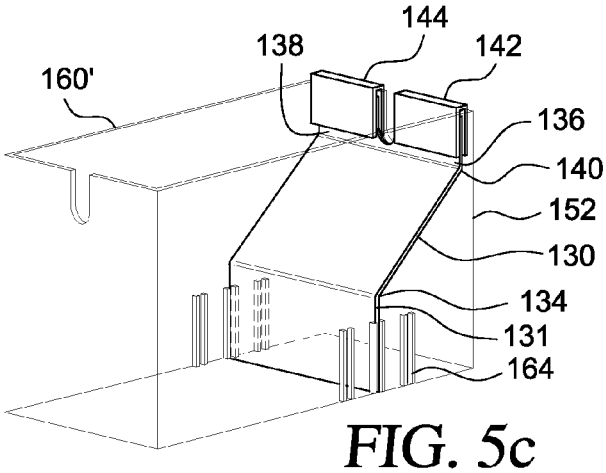
FIG. 5*c* shows the insert of FIGS. 5*a* and 5*b* within an ice bucket having slotted inserts.

In a third embodiment depicted in FIGS. 5*a*-5*c*, an insert 126 includes first and second deflectors 130 and 131 connected by a first hinge 134, such as a living hinge. First and second tab portions 136 and 138 may be integrally connected to first deflector 130 or may be hingedly connected thereto by a second hinge 140 as depicted in FIGS. 5*a*-5*c*. Although shown as living hinges, it should be understood that first and second hinges 134 and 140 may be any standard hinge known in the art.

First and second clips 142 and 144 are connected to respective first and second tab portions 136 and 138, and are adapted to selectively attach insert 126 to one of opposing side walls 150 or 152 of a shelf-mounted ice bucket 160. While shown as separate from first and second tab portions 136, 138, first and second clips 142 and 144 may alternatively be integrally formed therewith. In use, first and second hinges 134 and 140 allow second deflector 131 to extend in a first direction substantially perpendicular to first and second tab portions 136 and 138 as depicted in FIG. 5*a*, or extend in a second direction at an angle with respect to first and second tab portions 136 and 138, as depicted in FIG. 5*b*. As should be readily understood, when second deflector 131 is a first angle as depicted in FIG. 5*a*, the useable storage volume of insert 126 will be decreased more than it will be decreased when second deflector 131 is at a second angle as depicted in FIG. 5*b*. Thus, a consumer can choose to utilize insert 126 in either configuration depending on the storage volume desired in ice bucket 160. Additionally, first and second hinges 134 and 140 enable insert 126 to be folded for storage when not in use.

The first hinge 134 may be configured to "lock" in place at a desired angle. Alternatively, insert 126 may be utilized in conjunction with an ice bucket 160' that includes multiple slotted retainers 164 as depicted in FIG. 5*c*. Various sized inserts may be utilized with this configuration, or insert 126 may include additional living hinges (not shown) or a telescoping first deflector 130 to enable insert 126 to be reconfigured to fit within the various slotted retainers 164. In addition, insert 126 may included vertically adjustable first and second tab portions 136 and 138 to allow for repositioning between various slotted retainers 164. Regardless, slotted retainers 164 allow a user to position insert 126 at one of a plurality of angular positions, thereby providing for varying ice storage volumes within ice bucket 160'.

Figure 6:
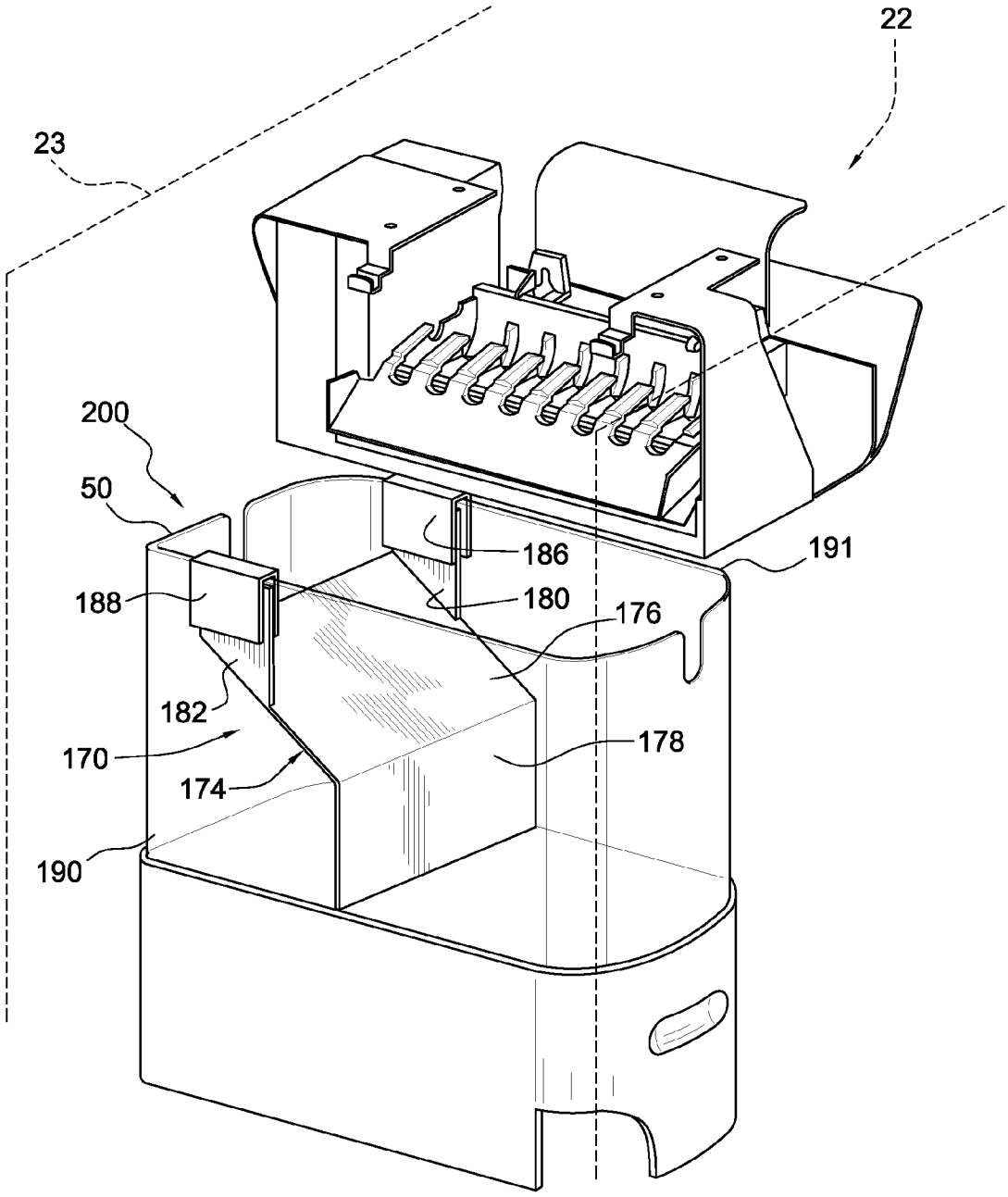
FIG. 6 is a perspective view of an ice storing and dispensing assembly with a side wall mounted ice bucket and a fourth insert embodiment of the present invention.

In a fourth embodiment depicted in FIG. 6, a removable insert 170 comprises a main body portion 174 including a solid first deflector 176 and a solid second deflector 178 extending there from. Additionally, opposing first and second tab portions 180 and 182 extend from first deflector 176 and include respective first and second clips 186 and 188 adapted to attach insert 170 to front and back walls 190 and 191 of a side-mounted ice bucket 200. As with the third embodiment, insert 170 may include hinges (not shown) connecting first and second deflectors 176 and 178, or may be of unitary construction. Additionally, although clips 186 and 188 are shown as separate and distinct from respective first and second tab portions 180 and 182, it should be understood that they may be formed integrally with tab portions 180 and 182.

Figure 7:
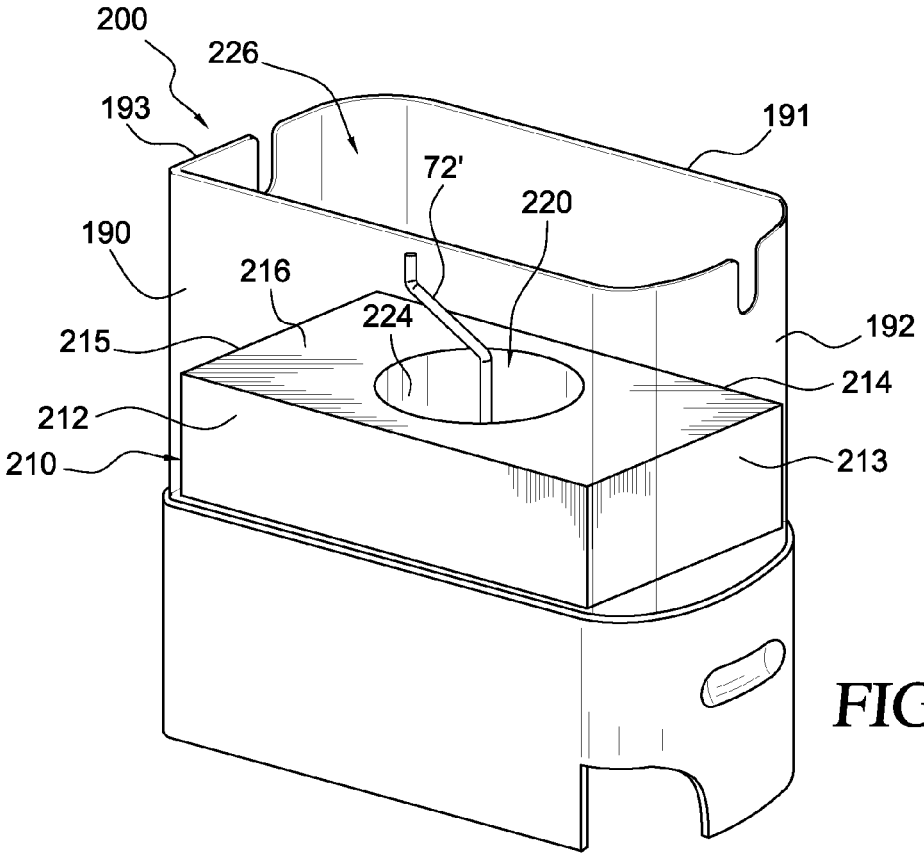
FIG. 7 is a perspective view of a side wall mounting ice bucket and a fifth insert embodiment of the present invention.
Figure 8:
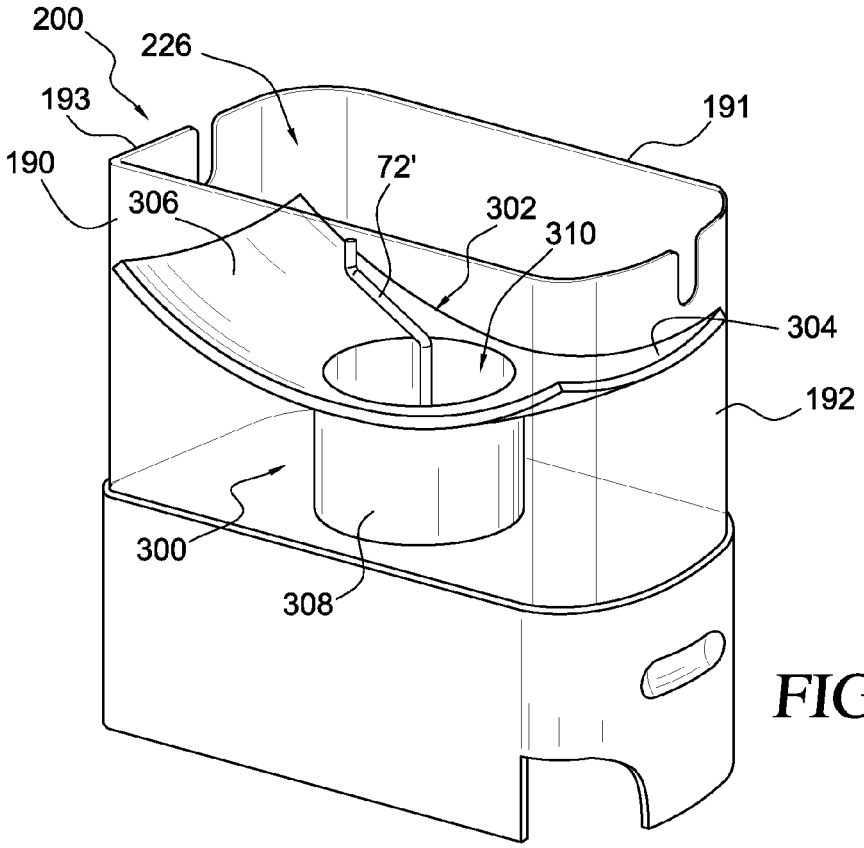
FIG. 8 is a perspective view of a side wall mounting ice bucket and a sixth insert embodiment of the present invention.

Still further embodiments of the present invention are depicted in FIGS. 7 and 8, respectively. FIG. 7 depicts a removable block insert 210 including side walls 212-215 and a top wall 216. A dispensing aperture 220 is located in top wall 216 and is defined by an inside wall 224 extending through block insert 210. Block insert 210 may be solid, or may be a hollow shell defined by walls 212-216 and inside wall 224. Regardless, block insert 210 is preferably sized to extend substantially the entire length and width of ice bucket 200, and extend to a height less than the height of ice bucket walls 190-193. In this manner, block insert 210 reduces the volume of the ice buckets storage cavity 226, while allowing ice to fall through dispensing aperture 220 to an external ice service area, such as service area 31 depicted in FIGS. 1 and 3. When utilized with an auger-type dispensing system as shown, block insert 200 is sized and configured such that an auger 72' may extend through aperture 220, and block insert 200 does not interfere with the function of auger 72' within ice bucket 200.

A generally similar, removable curved insert 300 is depicted in FIG. 8, and includes a top wall 302 having first and second scooped portions 304 and 306, and a dispensing wall 308 defining a dispensing aperture 310 that extends through top wall 302. First and second scooped portions 306 and 308 are preferably curved to direct ice dispensed into ice bucket 200 into dispensing aperture 310. Additionally, top wall 302 of scoop insert 300 is preferably sized to extend substantially the entire length and width of ice bucket 200, and extend to a height less than the height of walls 190-193. In this manner, scoop insert 300 reduces the capacity of storage cavity 226, while allowing ice to fall through dispensing aperture 310 to external an ice service area, such as ice service area 31 depicted in FIGS. 1 and 3. Additionally, insert 300 is sized such that auger 72' may extend through aperture 310 without insert 300 interfering with the function of auger 72' within ice bucket 200.

Although various ice bucket embodiments are depicted and described, it should be understood that the inserts of the present invention are intended for use in a variety of standard ice buckets and should not be limited to those ice bucket configurations discussed herein. Additionally, although described with reference to preferred embodiments of the invention, it should be readily understood that various changes and/or modifications can be made to the invention without departing from the spirit thereof. For instance, the particular structure utilized to attach a given insert to an ice bucket may be varied without departing from the spirit of the invention. In general, the invention is only intended to be limited by the scope of the following claims.

What is claimed is:

1. A refrigerator comprising:

a cabinet;

a freezer compartment arranged within the cabinet;

a door mounted to the cabinet for selectively providing access to the freezer compartment;

an ice maker disposed within the freezer compartment for forming ice pieces;

a variable capacity ice storage assembly comprising:

an ice bucket including bottom, front, back and opposing side walls establishing a top rim and defining a storage cavity adapted to receive ice pieces dispensed from said ice maker; and a removable insert including:

a main body portion including a solid first deflector and a solid second deflector directly attached to the first deflector;

a first tab portion attached to the main body portion including a first clip configured to be removably attached to one of the front, back and opposing side walls of the ice bucket, with the first tab portion extending up from the main body portion along the one of the front, back and opposing side walls adjacent the top rim and the first clip interconnecting the first tab portion to the ice bucket while extending over the top rim; and a second tab portion attached to the first deflector and including a second clip configured to be removably attached to one of the front, back and opposing side walls of the ice bucket, with the second tab portion also extending up from the main body portion along the one of the front, back and opposing side walls to adjacent the top rim and the second clip interconnecting the second tab portion to the ice bucket while extending over the rim.

2. The refrigerator of claim 1, further comprising an auger extending into the storage cavity from the bottom wall, wherein the second deflector is adapted to extend between one of said front and back walls and the auger.

3. The refrigerator of claim 1, wherein the main body portion of the variable capacity ice storage assembly further includes a curved portion.

4. The refrigerator of claim 1, wherein the first deflector is attached to the second deflector by a first hinge.

5. The refrigerator of claim 4, wherein the first hinge is a living hinge.

6. The refrigerator of claim 1, wherein the first and second tab portions are adapted to selectively connect to respective opposing side walls of the ice bucket.

7. The refrigerator of claim 1, wherein the first and second tab portions are hingedly attached to the main body portion.

8. The refrigerator of claim 1, wherein the first tab portion and first and second deflectors are integrally formed.

9. A variable capacity ice storage assembly comprising:

an ice bucket including bottom, front, back and opposing side walls defining a storage cavity adapted to receive ice pieces dispensed from an ice maker; and a removable insert including:

a main body portion including a solid first deflector and a solid second deflector directly attached to the first deflector by a first hinge; and a first tab portion attached to the main body portion including a first clip configured to be removably attached to one of the front, back and opposing side walls of the ice bucket, wherein the first tab portion is attached to the main body by a second hinge.

10. The variable capacity ice storage assembly of claim 9, wherein the second deflector is adapted to extend between one of said front and back walls of the ice bucket and an auger extending into the storage cavity of the ice'bucket.

11. The variable capacity ice storage assembly of claim 9, wherein the main body portion further includes a curved portion.

12. The variable capacity ice storage assembly of claim 9, wherein the first hinge is a living hinge.

13. The variable capacity ice storage assembly of claim 9, further comprising a second tab portion attached to the first deflector and including a second clip configured to be removably attached to one of the front, back and opposing side walls of the ice bucket.

14. The variable capacity ice storage assembly of claim 13, wherein the first and second tab portions are adapted to selectively connect to respective opposing side walls of the ice bucket.

15. The variable capacity ice storage assembly of claim 13, wherein the first tab portion is hingedly attached to the main body portion.

16. The variable capacity ice storage assembly of claim 9, wherein the first tab portion and first and second deflectors are integrally formed.

17. A method of varying an ice storage capacity of an ice bucket including bottom, front, back and opposing side walls establishing a top rim defining a storage cavity adapted to receive ice pieces dispensed from an ice maker, the method comprising:

placing an insert into a storage cavity of the ice bucket, the insert including a main body portion having a solid first deflector, a solid second deflector directly attached to the first deflector, a first tab portion and a second tab portion, with each of the first and second tab portions extending up from the main body portion along a respective one of the front, back and opposing side walls to adjacent the top rim;

removably attaching a first clip of the first tab portion to one of the front, back and opposing side walls of the ice bucket and;

removably attaching a second clip of the second tab portion to one of the front back and opposing side walls of the ice bucket, with the first clip and the second clip respectively interconnect the first tab portion and the second tab portion to the ice bucket while extending over the top rim, wherein the insert reduces the ice storage capacity of the storage cavity and deflects ice dispensed into the ice bucket towards the bottom wall of the ice bucket.

18. The method of claim 17, further comprising: positioning the solid second deflector in a selected one of first or second angled positions within the storage cavity, wherein positioning the solid second deflector in the first angled position results in a first reduced ice storage capacity and positioning the solid second deflector in the second angled position results in a second reduced ice storage capacity which is different from the first reduced ice storage capacity.

* * * * *